US005931602A

United States Patent [19]

Gulbrandsen et al.

[11] Patent Number: 5,931,602

[45] Date of Patent: Aug. 3, 1999

[54] DEVICE FOR OIL PRODUCTION AT GREAT DEPTHS AT SEA

[75] Inventors: Håvard Gulbrandsen, Høvik; Stig Bøtker Rasmussen, Sandvika, both of Norway

[73] Assignee: Kvaerner Oil & Gas a.s, Lysaker, Norway

[21] Appl. No.: 08/722,319

[22] Filed: Sep. 27, 1996

Related U.S. Application Data

[63] Continuation of application No. PCT/NO95/00063, Apr. 11, 1995.

[30] Foreign Application Priority Data

Apr. 15, 1994 [NO] Norway ..... 94 1387

[51] Int. Cl.[6] ..... E02B 17/00; B63B 35/44

[52] U.S. Cl. ..... 405/224; 166/359; 405/195.1

[58] Field of Search ..... 405/224, 195.1, 405/224.1, 224.2, 224.3, 224.4; 166/359, 350, 367

[56] References Cited

U.S. PATENT DOCUMENTS

| | | | |
|---|---|---|---|
| 4,004,531 | 1/1977 | Mott . | |
| 4,194,568 | 3/1980 | Buresi et al. | 166/359 X |
| 4,215,950 | 8/1980 | Stevenson | 166/359 X |
| 4,436,451 | 3/1984 | Anderson . | |
| 4,702,321 | 10/1987 | Horton . | |
| 4,753,553 | 6/1988 | Carlsen et al. | 405/224 X |
| 4,793,738 | 12/1988 | White et al. | 405/224 |
| 4,913,238 | 4/1990 | Goldman . | |
| 4,934,870 | 6/1990 | PEtty et al. | 405/224 X |
| 5,439,321 | 8/1995 | Hunter | 405/224 X |
| 5,542,783 | 8/1996 | Pollack | 405/224 X |

FOREIGN PATENT DOCUMENTS

| | | |
|---|---|---|
| 0 245 177 | 2/1988 | European Pat. Off. . |
| 2172262 | 9/1986 | United Kingdom . |

*Primary Examiner*—Dennis L. Taylor
*Attorney, Agent, or Firm*—W. Warren Taltavull; Farkas & Manelli PLL

[57] ABSTRACT

In a device for oil production at great depths at sea, production/drilling equipment is provided on a floating structure (2) at the surface of the sea, such as a platform structure or a vessel structure, for instance a ship, which is connected to a flotation unit (5) under water, which is anchored with a tension mooring (4) to the sea floor and with a riser system (6) which extends upwardly to the deck (9) of the structure. The structure (2) is equipped with an open vertical frame construction (8), such as a trusswork projecting downwardly in the water, the lower part of which forms a guide (17) and protection for the flotation unit (5). The rigid risers (4) from the sea bed continue up with the system (6) through the flotation unit (5) and further, enclosed by the frame (8) up to the level of the deck (9) above the water surface, where they are terminated in a Christmas tree device (7), or a manifold. A flexible riser system (11) extends from the valve arrangement (7), e.g. in a pendulous arc to the deck (9), the pipes (11) being dimensioned to permit a maximum height displacement between deck and flotation unit.

6 Claims, 2 Drawing Sheets

DEVICE FOR OIL PRODUCTION AT GREAT DEPTHS AT SEA

This is a Continuation of International Appln. No. PCT/NO95/00063 filed Apr. 11, 1995, which designated the U.S.

FIELD OF THE INVENTION

The invention concerns a device for oil production at great depths at sea, wherein production/drilling equipment is provided on a structure on the surface of the sea, such as a platform structure or a ship or other vessel structure which is connected to a flotation unit under water, which is tension moored to the sea bed by tension stays and/or by a riser system which extends up to the structure. There are previously known devices for use in connection with oil production which are composed of a combination of a semisubmersible platform and a relatively small tension leg platform. Such a structure is described, e.g., in U.S. Pat. No. 4,913,238. In this platform structure which is described in this patent a tension leg platform is terminated in a flotation unit which may either be located below the surface of the sea or above the surface, in an area which lies between the legs of the semisubmersible platform. A riser connection is then established between the tension leg platform's flotation unit or the upper part of the semisubmersible platform. In the case where the flotation unit is located below the surface of the water, a watertight barrier is provided to ensure water-free access to the upper part of the tension leg platform.

BACKGROUND OF THE INVENTION

In U.S. Pat. No. 4,966,495 there is further described a floating drilling and production unit in which there is provided an upper part of a tension leg platform. In this design too the top of the tension leg platform is located at surface level. In U.S. Pat. No. 4,702,321 there is described a drilling and production platform with a deep-floating flotation unit from which tension stays extend down to the sea bed and where the floating part is secured by means of a radiating system of anchors.

None of these known structures, however, is intended for use at great depths and under rough weather conditions, nor will it be possible for the structure to be used under such conditions. A tension leg platform of a conventional type which extends over a water depth of, e.g., 800 to 1000 m or more and under rough weather conditions will necessitate the use of a very heavy and very expensive tension leg system. It has further been found that this type of platform has its limitations. One of the difficulties, which is also partially encountered at normal water depths of 3–500 m, is problems in connection with the oscillations to which the tension stays are exposed, including natural frequencies. These will lead to fatigue loads on the stay and are the result, amongst other things, of movements in the water such as wave motion. These phenomena and fatigue loads will be reinforced at depths of the said magnitude of 800 to 1000 m under rough weather conditions and entail a limitation in the use of the tension leg platform under such conditions.

The use of flexible riser pipes will also be restricted at such great depths due to technical conditions which arise from the great hydrostatic pressure, amongst other factors. In any case, flexible risers suitable for this depth will be extremely expensive.

SUMMARY OF THE INVENTION

The object of the invention, therefore, is to provide a production and drilling structure which will be able to be used at very great depths, including depths greater than 1000 m.

This object is achieved with a device of the type mentioned in the introduction, which is characterized by the features presented in the patent claims.

The design according to the invention permits the use of a tension leg structure even at such great depths, the movements of the tension leg structure and its oscillation frequency being controlled in such a manner that these are substantially suppressed. This is achieved by installing a tension leg structure's part or flotation unit so far below the surface of the water that the entire tension leg structure is affected to as small an extent as possible by movements and disturbances in the water, these movements normally occurring in the uppermost layer. The flotation unit is tensioned either by means of the risers alone or in the structure with separate tension stays. The floating structure is equipped with a casing or the like which may be connected to a frame construction, for instance a trusswork which extends down to the level of the tensioned flotation unit, and which forms a guiding or sliding securing of the flotation unit. This results in the substantial stabilization of the tension leg structure in its vertical position, which enables tensioning by means of risers or by means of a simplified tension leg system, the loads on the tension leg unit thereby being reduced to a minimum. At the same time rigid risers can be employed which can extend upwardly through the flotation unit and right up to above the surface of the water until they are an a level with the deck of the floating structure. This means that the wellhead Christmas trees or manifolds which are placed at the top of the rigid risers will be located above the water surface, thus enabling coupling, uncoupling and other manoeuvres to be performed in a dry environment. A flexible riser part is then passed from the Christmas trees over to the actual platform with connections to the other production units. This transition could also be effected by means of rigid steel tubes which are articulated in special couplings.

The risers are arranged in this manner in an opening in the deck and will be easily accessible. At the same time this cavity in the deck can be used for installing a drilling rig, thus permitting drill pipes to be passed down through the tensioned part, and enabling the structure to be used both for drilling and for production.

By designing the floating structure's lower part as a frame, for instance as a trusswork, a rigid and reliable protection and guidance of the tension leg structure's flotation unit are obtained, while at the same time the rigid risers, projecting up from the flotation unit to the deck, are well protected, thus permitting them to stand or rise up freely. If so desired, these can be enveloped by a pipe member in order to provide further protection. It is not a condition that the lower part of the structure should be arranged as a trusswork. However, it is necessary to arrange a guidance system for the flotation unit. This can be done by means of a trusswork system, amongst other solutions.

This deep-draught structure can also be employed for mounting a standard catenary mooring for the floating structure, thus enabling the mooring point to be advantageously located in its lower part. A catenary mooring of this kind is also an advantageous, inexpensive solution. In the event of wave movements and in strong wind the floating structure could drift out to the side, thus bending the tension stays about an angle of, e.g. 5–7.5. At a depth of e.g. 1400 m the consequence of this will be that the flotation unit will be pulled vertically downwards in its guide about a length of between 7 and 14 m. This displacement will only occur in one direction and there will be no problem in compensating for it by means of the flexible risers which have been extended from the wellhead Christmas tree or manifold at the top of the riser device. Thus it has surprisingly been shown that with a structural design according to the invention the tension leg structure part can be so well controlled that a simplified variant of this kind can also be used at very great depths, the loads which otherwise act on the tension stays being avoided, while at the same time achieving a dry and reliable transfer of the risers up to wellhead Christmas trees above the surface and with a flexible transition to the actual production plant.

A further advantage of the design of the structure is the opportunity it offers to reduce the distance between the risers at deck level. The necessary distance between the risers, e.g. for 1400 m, will normally be 5 m or more in order to avoid collision. For 300–500 m this spacing will normally be 2.5 to 3 m.

By arranging the risers through a flotation unit which is well submerged, it will therefore be possible to maintain, e.g. a 5 m spacing between the risers at the bottom of the flotation unit, while the distance between the risers at deck level can be less, e.g. 2.5 m. This allows a substantial saving to be made on the deck, since the structural design of the deck becomes simpler with the consequent savings in steel weight and costs.

In this case such a splay of the risers will normally be in the range of 1–2 degrees. This will not entail any major problems for the risers or the drilling operation, but will provide substantial benefits for the arrangement of the Christmas tree area and related deck solution.

BRIEF DESCRIPTION OF THE DRAWINGS

The invention will now be described in more detail by means of an embodiment which is illustrated schematically in the drawing, in which.

DETAILED DESCRIPTION

Figure 1:
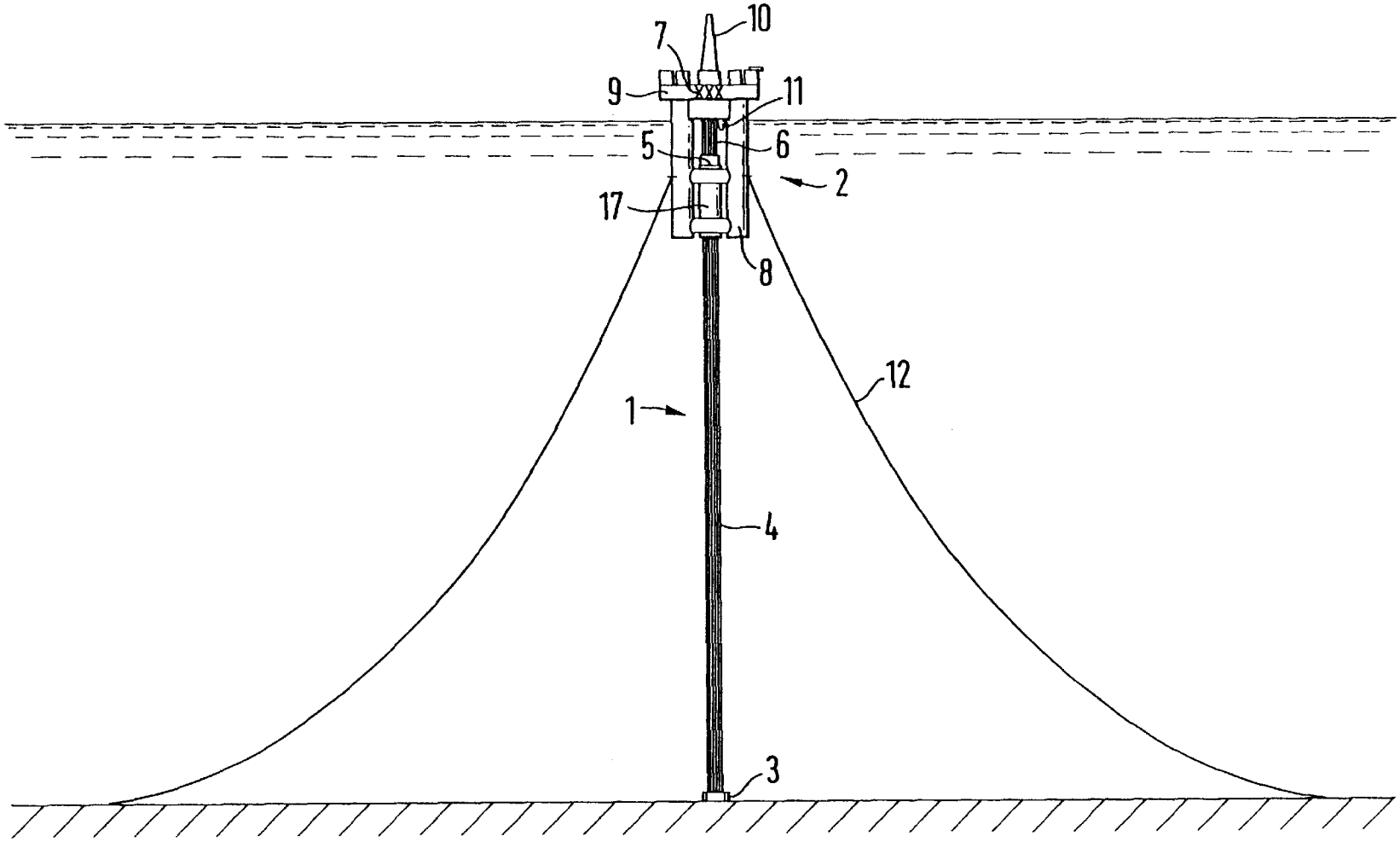
FIG. 1 is a side view of a device according to the invention used in a platform structure.

The drawings illustrate a device according to the invention, and it is as an embodiment shown a semisubmersible platform structure which is composed of a lower tension leg platform part 1 and an upper semisubmersible platform structure which is generally indicated by 2. The platform part, i.e. the deck is indicated by 9, while the shaft part or lower part is indicated by 8. The lower part is designed here as a framework, but can, e.g. in the case of a concrete structure, also be in a different form. The tension leg platform is attached to the sea floor and the risers which extend up to the platform part's flotation unit 5 extend from a riser frame 3 on the sea bed. The risers and possibly the tension stays are generally and jointly indicated by reference numeral 4. The tension leg platform's flotation unit 5 is mounted so far below the surface of the water that it is affected to the least possible extent by movements in the water. Above the flotation unit the risers extend further as rigid elements 6 up to above the surface and are terminated there in a Christmas tree device 7. If so desired, the Christmas tree device can also be combined with a manifold. From the Christmas tree device flexible risers lead to a connection point on the actual production platform deck 9. The length and the arrangement of the flexible risers are provided in such a length and in such a manner that they will be capable of absorbing displacements of the flotation unit in relation to the floating platform. Above the cavity in the platform deck 9 where the risers are terminated, drilling facilities 10 can be provided to enable drilling to be performed down through the platform to the sea bed. This is only illustrated in a purely schematic manner by indicating a drilling tower 10. The floating platform is secured by means of a catenary mooring line which is generally indicated by 12.

Figure 2:
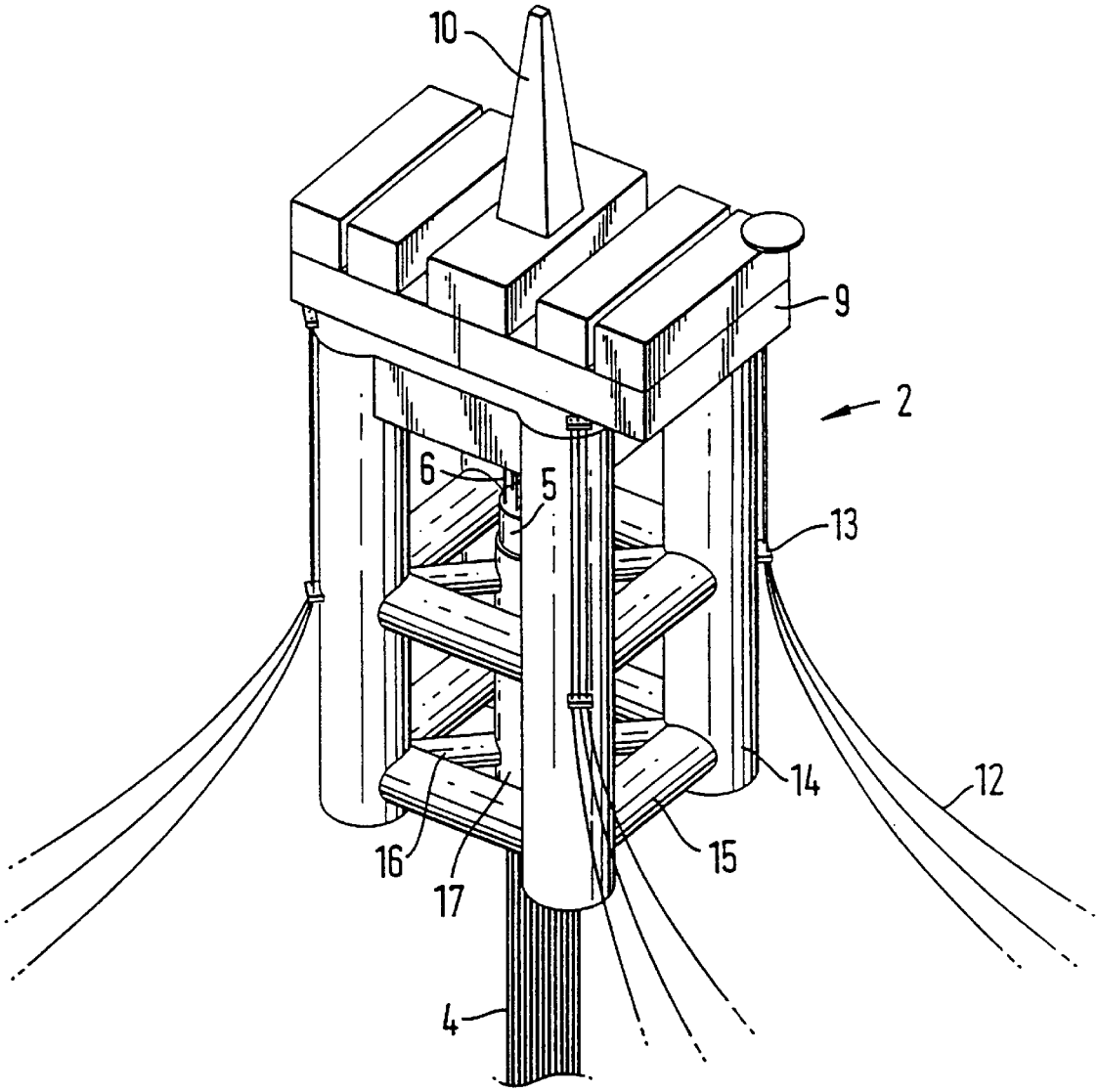
FIG. 2 is a perspective view illustrating the upper part of this device according to the invention.

In FIG. 2 the upper part of the device according to the invention is illustrated in more detail. Here the floating platform structure 2 can be seen with the platform deck 9 and the shafts or the submerged structural part which comprises vertical columns 14 with cross elements 15 and 16. These elements 14, 15 and 16 together form a trusswork part which, apart from providing the necessary buoyancy, is intended to protect the upper part of the tension leg platform and the upwardly projecting riser pipes 6. The submerged part of the platform is made so long that it projects down to the still water level where the flotation unit 5 is located. The flotation unit 5 is preferably provided in a guiding casing 17 which causes the flotation unit to be able to perform only vertical movements. It has been shown that under the influence of wind and weather the platform will essentially only move out to the side and this means that the flotation unit 5 will substantially move in a downward direction, and thereby will not be forced upward to a height above the structural level obtained with a purely vertical positioning of the tension leg platform. This means that the rigid risers 6 can be continued up to the level of the platform deck 9 where there can be provided wellhead Christmas trees, and possibly manifolds for further transmission of the products. Here in this dry location there are connected flexible risers which lead to production facilities on the deck 9. These structural parts are not illustrated in more detail. The catenary mooring line of the semisubmersible platform can be mounted parallel to the platform leg 14 in the upper part, with the result that the catenary line starts from an anchor point 13 which can be located at a brace in the trusswork.

The illustrated design with a trusswork lower structure on the semisubmersible platform results in the pattern of movement for the related tension leg platform part being controlled to such an extent that it is possible to have a simplified tensioning of the structure, which is simultaneously kept as still as possible, thus keeping material fatigue and all the problems which that entails to a minimum. Thus there is provided by simple means a production and drilling platform which can be used both at normal depths, but above all is also intended for use at great depths such as 1000–2000 m, and where the platform can also have space for storing oil products. The device can, of course, also be employed at water depths less than 600 m.

Even if the invention has been described above with reference to a semisubmersible platform structure, it is clear that the inventive idea also may be used for other types of vessels, for instance ships. Also such structures are regarded as being within the scope of the invention.

We claim:

1. An offshore floating platform for use in oil production or drilling at great depths at sea, said platform being anchored by a plurality of lines to the sea floor and including a deck and a central axis, a truss structure depending from said deck and defining an enclosure surrounding a space below said deck, said truss structure including a plurality of outer legs extending from said deck, a flotation unit located in said space, at least one riser extending from the sea floor and connected at one end to said flotation unit, said flotation unit being movably disposed in a casing member supported by said truss structure at a position in use that is below the level of wave action of the sea, said deck having at least one conduit connected to said flotation unit and having a length to allow vertical movement between said deck and said flotation unit, said truss structure including a plurality of hollow tubes with some of said plurality of tubes joined to said casing member to space said casing member from said outer legs of said truss structure to allow substantial wave flow through said truss structure.

2. The platform is claimed in claim 1 wherein said deck includes a Christmas tree structure to which said at least one conduit is connected through an opening in said deck.

3. The platform as claimed in claim 1 wherein said flotation unit is adapted to permit a drill pipe from a drilling tower to be passed there through with said drilling tower being located on said deck.

4. The platform as claimed in claim 1, where said riser extends downwardly to depths between 600 and 2000 m.

5. The platform as claimed in claim 4 wherein a plurality of risers is employed with the risers located adjacent to the sea floor being spaced apart a greater distance than the portion of said risers located adjacent said deck.

6. The platform is claimed in claim 1 wherein a plurality of conduits are provided extending from said deck to said flotation unit and said plurality of conduits are suspended in a pendulous arc from said deck.

* * * * *